US009010233B2

(12) United States Patent
St. George

(10) Patent No.: US 9,010,233 B2
(45) Date of Patent: Apr. 21, 2015

(54) FIREARM ACTION AND GAS SYSTEM

(71) Applicant: Tactical Arms Holdings Co., LLC, Plainville, CT (US)

(72) Inventor: Charles St. George, Murfreesboro, TN (US)

(73) Assignee: Tactical Arms Holdings Co., LLC, Plainville, CT (US)

( * ) Notice: Subject to any disclaimer, the term of this patent is extended or adjusted under 35 U.S.C. 154(b) by 0 days.

(21) Appl. No.: 14/109,483

(22) Filed: Dec. 17, 2013

(65) Prior Publication Data

US 2014/0331853 A1 Nov. 13, 2014

Related U.S. Application Data

(60) Provisional application No. 61/797,900, filed on Dec. 17, 2012.

(51) Int. Cl.

| | |
|---|---|
| ***F41A 5/00*** | (2006.01) |
| ***F41A 5/20*** | (2006.01) |
| ***F41A 19/12*** | (2006.01) |
| ***F41A 19/13*** | (2006.01) |
| ***F41A 19/14*** | (2006.01) |
| ***F41A 3/12*** | (2006.01) |
| ***F41A 19/10*** | (2006.01) |
| ***F41A 21/36*** | (2006.01) |
| ***F41C 7/00*** | (2006.01) |

(52) U.S. Cl.

CPC . *F41A 5/20* (2013.01); *F41A 19/12* (2013.01); *F41A 19/13* (2013.01); *F41A 19/14* (2013.01); *F41A 3/12* (2013.01); *F41A 19/10* (2013.01); *F41A 21/36* (2013.01); *F41C 7/00* (2013.01)

(58) Field of Classification Search

CPC ..... F41A 3/12; F41A 5/18; F41A 5/20; F41A 19/10; F41A 19/12; F41A 19/13; F41A 19/14; F41A 19/25; F41A 19/27; F41A 19/42; F41A 19/43; F41A 19/44; F41A 19/45; F41C 7/00

USPC ..... 89/191.02, 192; 42/69.02

See application file for complete search history.

(56) References Cited

U.S. PATENT DOCUMENTS

| | | | | | |
|---|---|---|---|---|---|
| 2,211,405 | A | * | 8/1940 | Browning | 89/193 |
| 3,960,053 | A | * | 6/1976 | Conley | 89/149 |
| 4,279,191 | A | * | 7/1981 | Johansson | 89/185 |
| 4,635,530 | A | * | 1/1987 | Weldle | 89/159 |

(Continued)

*Primary Examiner* — Gabriel Klein

(74) *Attorney, Agent, or Firm* — Warner J. Delaune; Baker, Donelson, et al.

(57) ABSTRACT

A rifle in a bullpup configuration is provided, comprising a receiver having a trigger assembly and a magazine well, and a barrel having a barrel extension attached to the receiver. A gas assist system is attached to the barrel, including a gas housing surrounding the barrel and having an annular expansion chamber, and an annular gas piston slidably disposed within the gas housing. A thrust block is in contact with the gas piston, wherein the thrust block is slidably disposed along one or more action guide members. A rigid slide member extends from the thrust block and behind the trigger assembly. A bolt carrier and bolt are attached to the second end of the slide member and slidably disposed along one or more bolt guide members. The rifle further includes a linear hammer slidably disposed along one or more hammer guide members, and a sear assembly within the receiver having a sear member to retain the hammer, and a disconnector in communication with the sear member to release the hammer upon actuation of the trigger assembly.

36 Claims, 19 Drawing Sheets

(56) References Cited

U.S. PATENT DOCUMENTS

| | | | | |
|---|---|---|---|---|
| 4,817,496 | A * | 4/1989 | Zedrosser | 89/191.02 |
| 5,834,678 | A * | 11/1998 | Kalb | 89/187.01 |
| 7,950,178 | B1 * | 5/2011 | Landies et al. | 42/69.01 |
| 8,640,598 | B1 * | 2/2014 | Jackson | 89/191.02 |
| 2007/0180748 | A1 * | 8/2007 | Zemanek | 42/69.02 |
| 2011/0209607 | A1 * | 9/2011 | St. George | 89/191.01 |
| 2012/0137871 | A1 * | 6/2012 | O'Brien | 89/191.02 |

* cited by examiner

FIREARM ACTION AND GAS SYSTEM

CROSS-REFERENCE TO RELATED APPLICATIONS

This application claims the benefit under 35 U.S.C. §119 (e) to provisional application Ser. No. 61/797,900, filed Dec. 17, 2012.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to self-loading or semi-automatic firearms having an improved action and gas system, and more particularly to such firearms having a bullpup configuration.

2. Description of Related Art

Firearms, particularly those that are built to fire powerful cartridges such as the .50 BMG (.50 caliber Browning Machine Gun) round requires various devices to help reduce the recoil to an acceptable level while operating the weapon. Firearms that operate as above are known either as recoil or gas operated.

A recoil operated firearm generally allows the barrel (locked with the breech) to recoil rearwards within the receiver, and at a given point the barrel separates from the breech halting its rearward travel, whilst the breech mechanism continues rearwards extracting and ejecting the spent case. On its return stroke, the breech mechanism picks up a fresh round and loads it into the chamber.

To reduce the strong recoil, a muzzle brake may be attached to the front of the barrel. However, because this type of weapon relies on recoil to cycle the weapon, the muzzle brake's efficiency has to be limited, otherwise it will reduce the recoil necessary to operate the reloading cycle of the weapon. Further, because the barrel recoils inside the receiver, the receiver is heavy and complex in design, as it has to provide strong anchor points for the barrel recoiling system and the springs necessary for both the barrel and breech, that both operate separately during the cycle of operation.

Generally, in a gas operated weapon, a muzzle brake is still needed to reduce the recoil, which can be more efficient in its function, since the cycling of the weapon is not dependent on the recoil of the weapon. A gas operated weapon with a very efficient muzzle brake can be lighter in weight and shorter when having a "bullpup" configuration.

Additionally, gas operated and recoil operated firearms, in their current design and configuration, impede the design of shorter and more compact larger caliber firearms. Generally, the length of the breech system is determined by the length of the cartridge case and bullet and the firing system and positioned behind the magazine and able to reach the firing pin in the breech bolt. In addition, the receiver should be of sufficient length to allow full rearward travel of the breech to fully extract and eject the spent case and re-arming the hammer ignition system.

Furthermore, conventional rifles have their firing mechanisms positioned behind the magazine and ahead of the stock. A more recent configuration called a "bullpup" places the firing mechanism in front of the magazine eliminating the need for a separate stock and reduces the overall length of the firearm and its weight accordingly.

Firearms having bullpup configurations are known in the art. For example, one type of firearm having a bullpup configuration is the Steyr AUG. The Steyr AUG is a bullpup assault rifle used in several countries such as Austria and Australia. However, various other types of firearms having bullpup configurations are known in the art.

However, conventional bullpup rifles with a trigger positioned in front of the magazine are generally not practical for larger cartridges. The trigger may be inconveniently positioned too far forward causing excessive trigger pull or decreasing the precision of the firearm.

Therefore, there is a need for a self loading bullpup firearm with a compact breech and hammer mechanisms in smaller configurations which are not restricted by the overall length of the larger cartridge such as the .50 BMG and therefore reduces the overall length and weight of the firearm.

SUMMARY OF THE INVENTION

The foregoing and other problems are overcome, and other advantages are realized, by the use of the exemplary embodiments of this invention.

In accordance with one aspect of the invention, a bullpup self-loading rifle is disclosed. The bullpup rifle is adapted for firing high powered cartridge cases such as the .50 BMG rounds, having a receiver, which may include combination handguards, a gas system and slide attached to the breech mechanism and slidable inside the receiver, and a firing mechanism fixed inside the receiver, allowing for a much shorter breech bolt assembly and a much shorter and lighter firearm having a single piece receiver that supports the barrel and gas system assembly, bolt carrier group, ignition system, and the hammer sear release mechanism for trigger actuation.

In accordance with another embodiment of the invention, a rifle in a bullpup configuration is provided, comprising a receiver having a trigger assembly and a magazine well; a barrel having a barrel extension attached to the receiver; a gas assist system, including a gas housing surrounding the barrel and having an annular expansion chamber, and an annular gas piston slidably disposed within the gas housing; a thrust block in contact with the gas piston, wherein the thrust block is slidably disposed along one or more action guide members; a rigid slide member having a first end and a second end, wherein the first end is connected to the thrust block, and wherein the second end extends behind the trigger assembly; a bolt carrier having a bolt and firing pin, attached to the second end of the slide member and slidably disposed along one or more bolt guide members; a linear hammer slidably disposed along one or more hammer guide members, adapted to travel in a direction parallel to the bolt and to contact the firing pin; and a sear assembly within the receiver having a sear member to retain the hammer, and a disconnector in communication with the sear member to release the hammer upon actuation of the trigger assembly.

The trigger assembly may further include a trigger; and an ignition plate connected to the trigger, wherein the ignition plates extends across the magazine well to the sear assembly. The ignition plate further includes an opening for passage of a magazine.

The barrel of the rifle may further include a muzzle brake.

The linear hammer includes at least two body portions and a hammer member, wherein the body portions each include a tubular channel mated to the respective hammer guide members. The hammer includes at least two hammer spring rods extending from the hammer, and further including at least two hammer springs connected to the hammer spring rods.

In another embodiment, the action guide members are tubular, and the hammer springs are at least partially retained within the action guide members.

The action guide members include one or more action springs between the thrust block and the barrel extension.

The hammer preferably includes one or more hammer tabs adapted to engage the sear member.

In a more preferred embodiment, the sear member comprises a pair of sear arms rotatably connected to a sear holder, and wherein each sear arm includes a sear grip adapted to retain the hammer. The ignition plate communicates with the disconnector, wherein the disconnector communicates with a boss on the sear member, and wherein the disconnector causes the sear arms to disengage the hammer.

In another embodiment, the ignition plate includes ignition tabs, and where the sear arms are prevented from rotation when in contact with the ignition tabs.

In some embodiments, the disconnector is resiliently biased in a forward and upward position relative to the receiver.

In some embodiments, the sear member is resiliently biased in a position to retain the hammer.

In another embodiment, the disconnector is responsive to movement of the bolt carrier, and wherein the disconnector is reset to a firing position after the bolt carrier returns to the barrel extension.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
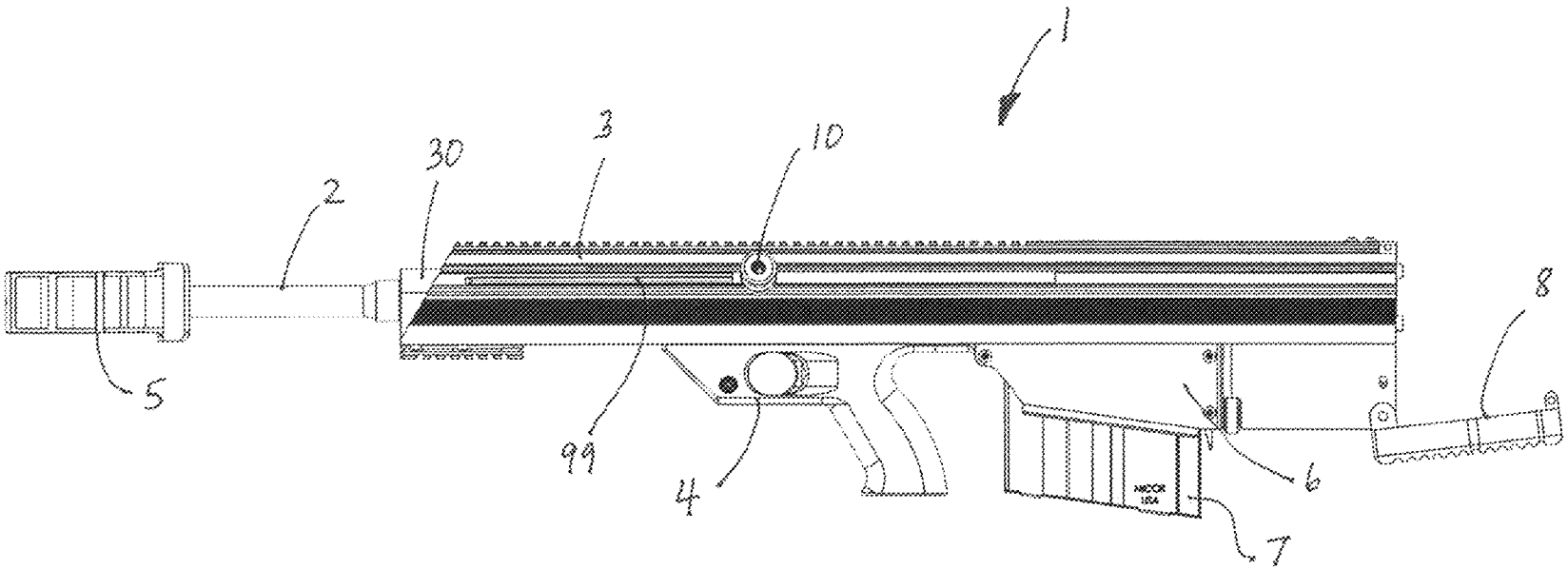
FIG. 1 is a side elevation view of a rifle in accordance with the description of the invention.

Referring to FIG. 1, there is shown a side elevation view of a bullpup rifle 1 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

In general, the present invention relates to a self-loading, gas operated rifle of a bullpup configuration referred to herein by referencing FIG. 1. The bullpup rifle 1 comprises a receiver 3. The receiver 3 serves as the super structure spine of the weapon. The body receiver also supports the entire operating mechanism that loads, locks the breech bolt to the barrel extension, fires the round, unlocks the breech bolt, extracts the fired round, continues rearwards and ejects said fired round's spent case and re-arms the hammer, and then returns forward and loads and chambers a fresh round ready to fire. The receiver 3 also serves as an anchor for a trigger assembly, a pistol grip housing 4, a magazine well 6, and a round box magazine 7, as well as a butt plate 8. However, it should be noted that any suitable type of magazine may be provided. The receiver 3 may be constructed of a durable material that is lightweight, rigid and may be constructed from an aluminum extrusion, plastic or carbon fiber. However, it should be noted that the receiver 3 may comprise any suitable configuration and/or material. The rifle further comprises a cocking/charging handle 10 disposed proximate a left side 99 of the receiver 3. The cocking/charging handle 10 is situated in the receiver 3 allowing direct operation and a non-reciprocating feature during firing of the weapon. The receiver 3 further supports a barrel 2 and a muzzle brake 5. The muzzle brake 5 diverts the exiting expanded gasses to the side and rearwards of the weapon to reduce the recoil.

Figure 2:
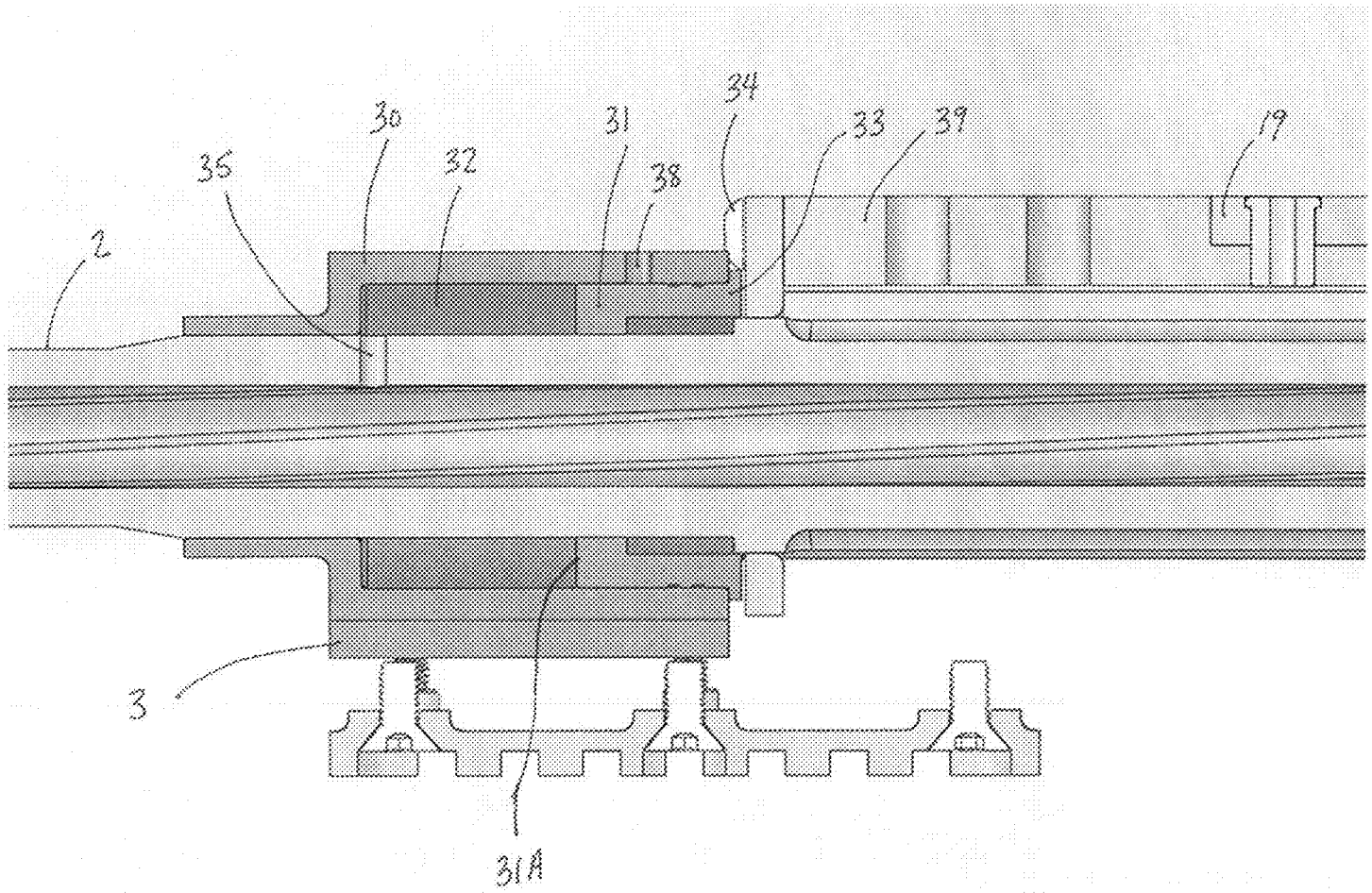
FIG. 2 shows a gas system assembly and expansion chamber in a closed (pre-firing) position.

FIG. 2 illustrates the gas system in a closed position, wherein the barrel 2 is sealably attached to the gas housing 30, and wherein the gas housing 30 is bolted to the receiver 3. A gas piston 31 resides within the gas housing 30 and is slidably disposed therein. Importantly, this design requires that the gas housing 30 completely surround the barrel 2, such that an annular piston surface 31A is employed in urging the gas piston 31 rearward. This arrangement provides a softer and more controlled movement of the gas piston 31, which is highly desirable in the bullpup configuration. One or more barrel bleed holes 35 are formed in the barrel 2 which are in communication with an expansion chamber 32 formed by the gas housing 30. In an initial or closed position prior to firing of a round, the gas piston 31 resides almost entirely within the gas housing 30, and the expansion chamber 32 is at its minimum volume. Prior to the firing of a round, the annular lip 33 of the gas cylinder 31 rests against the gas housing 30, urged into that position by the thrust bar 39 and slide 19. A thrust block, including thrust plate 34, is affixed to the front of the thrust bar 39 to receive the forces imparted by the gas piston 31 as explained below.

Figure 3:
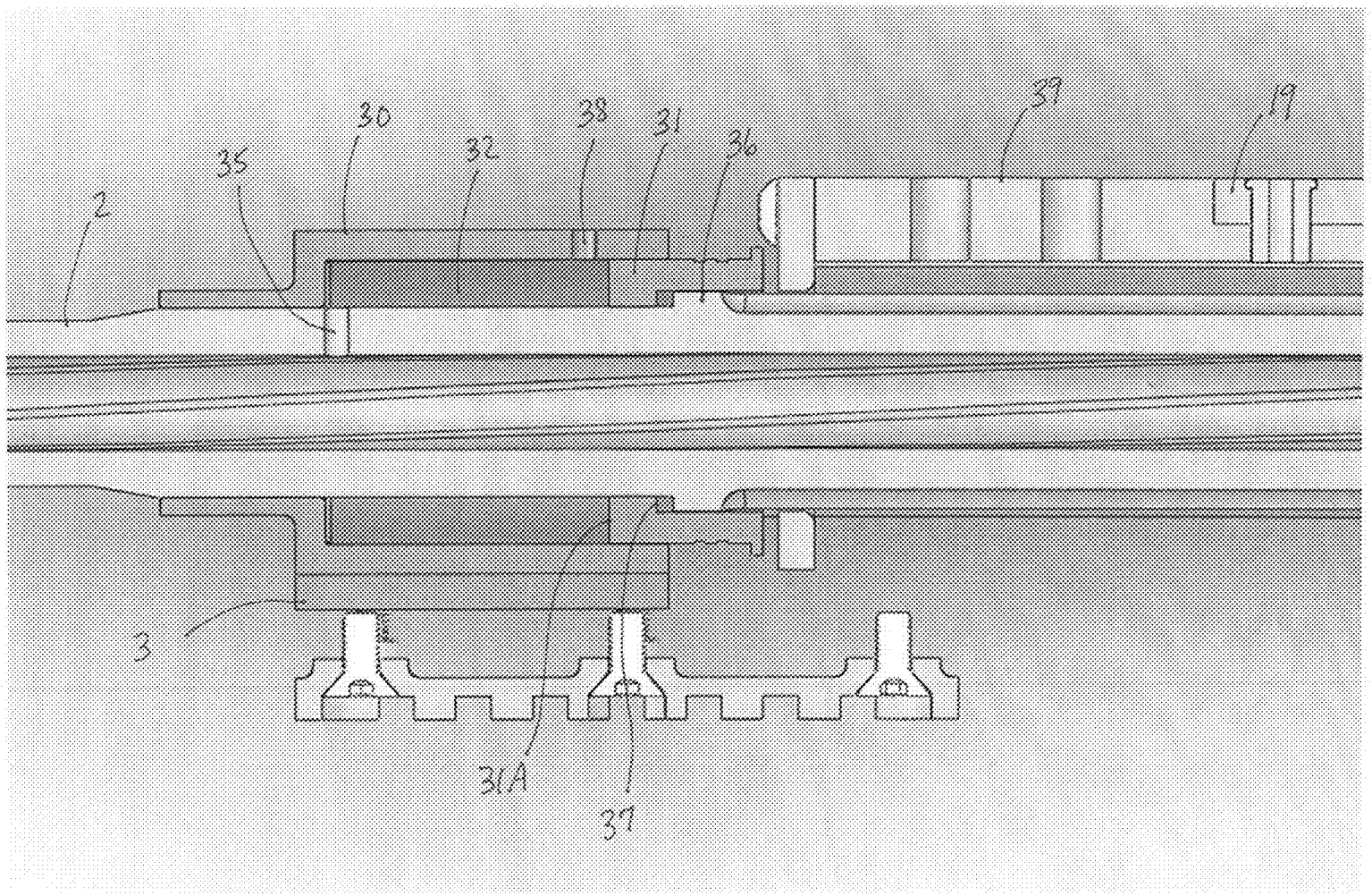
FIG. 3 shows the gas system assembly of FIG. 2 in an open position during expansion of exhaust gases after firing.

FIG. 3 depicts the gas piston 31 being sent rearwards as a result of the expanding gases being allowed to exit barrel bleed holes 35. As the gases expand within the expansion chamber 32, the gas piston 31 is urged rearward, pushing against the thrust plate 34, thrust bar 39, and slide 19 to assist in cycling the action as will be explained below. The gas system operates to assist the normal rearward movement of the action due to recoil (change in momentum) of the bolt 52 after a round is fired. The gas piston 31 is limited in its travel by a barrel step 36 which stops the gas piston 31 upon engagement with a piston lip 37. From this second or open position of the gas piston 31, an exhaust port 38 in the gas housing 30 is opened, allowing the release of excess gases from the expansion chamber 32. After cycling of the action and the loading of another round, the thrust bar 39 and slide 19 return to their normally forward position by the action springs 37, and the gas piston 31 is moved to its initial position as shown in FIG. 2.

Figure 4:
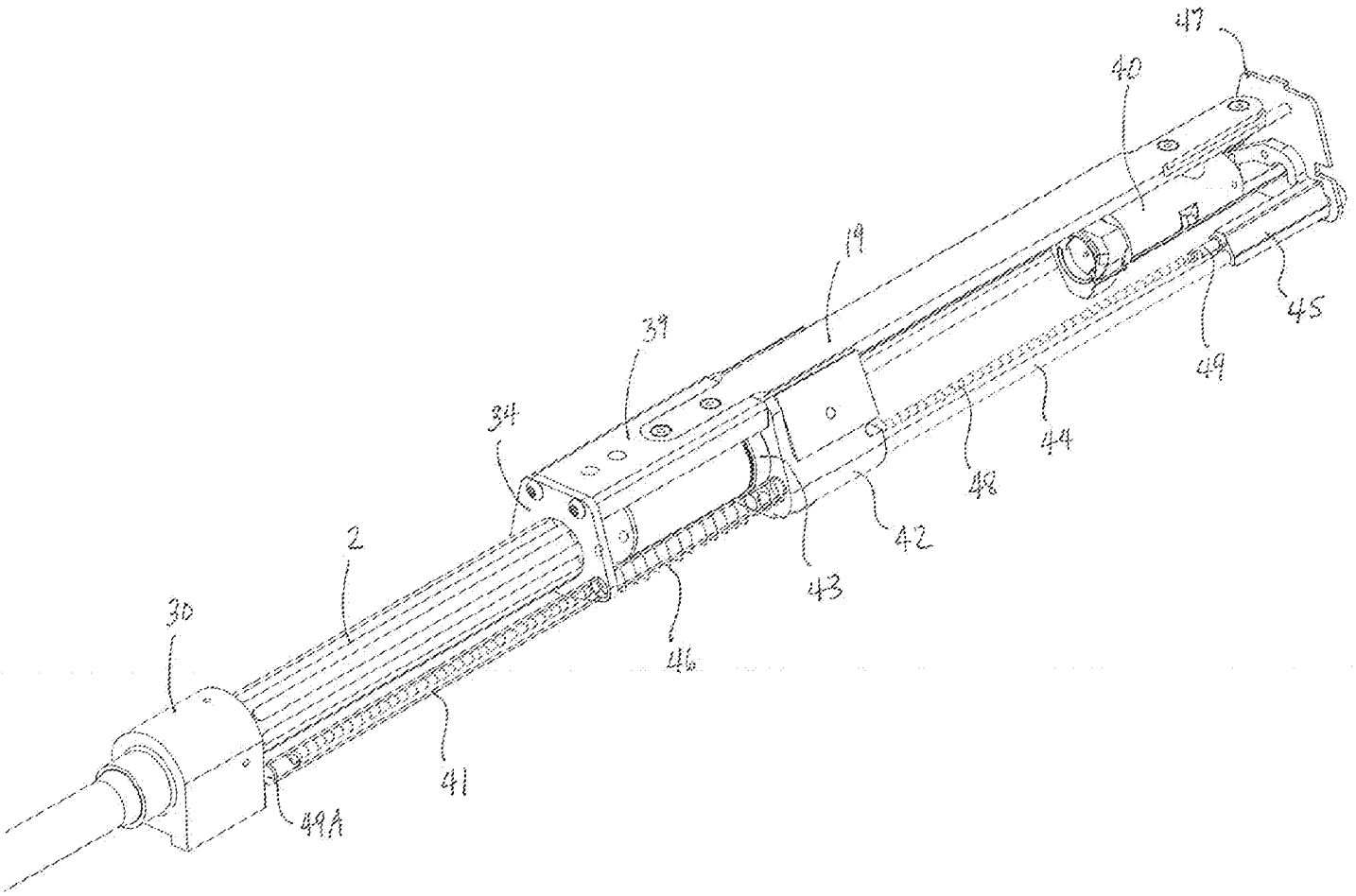
FIG. 4 shows a perspective view of some of the major components of the rifle.

FIG. 4 depicts a perspective view of the rifle 1, with several parts omitted for clarity in explaining the relationship between major components. The barrel 2 extends through the thrust plate 34 and under the thrust bar 39, where it is threadably attached to the barrel extension 42. Barrel nut 43 is used to keep the installed barrel 2 in a precise relationship with the barrel extension 42 to ensure proper headspace for the cartridge, as is common in the firearm manufacturing field. Slide 19 establishes a rigid connection between the thrust bar 39 and the bolt carrier group 40, so that these components move as an assembled unit during cycling of the action relative to the barrel 2 and barrel extension 42. In FIG. 4, the thrust plate 34 is shown in its most rearward position with the bolt carrier group 40 in contact with the action plate 47. The thrust plate 34 is guided along a pair of action spring guide tubes 41, and each of the action spring guide tubes 41 contain an external action spring 46 that bias the thrust plate 34 toward the gas piston 31.

Figure 4A:
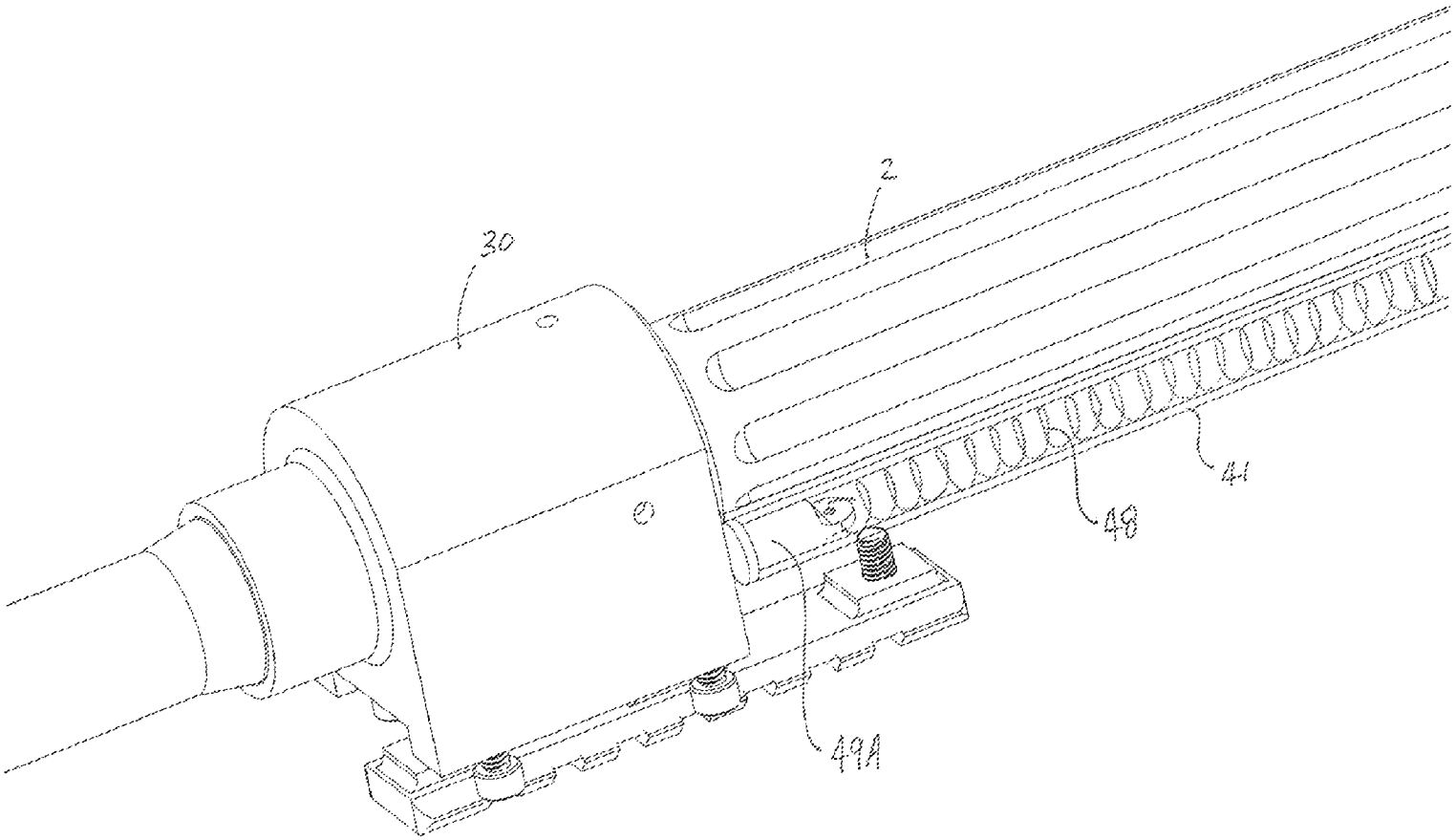
FIG. 4A shows a detailed view of the hammer spring within the action guide tube.

The barrel extension 42 is bolted to the receiver 3, and includes a feed ramp for allowing rounds to enter the barrel chamber. A pair of hammer guide rods 44 are connected between the barrel extension 42 and the action plate 47, and provide a guide for the unique linear hammer 45. In a cocked configuration, the hammer 45 is retained by the sear assembly 70 as will be further described. Upon release of the sear assembly 70 for firing a round, the hammer 45 travels along the hammer guide rods 44 by the action of two hammer springs 48. The hammer springs 48 are connected between hammer spring rods 49, which extend from the front of hammer 45, and front hammer spring holders 49A inserted into the front ends of the action guide tubes 41. Thus, hammer springs 48 pass through the barrel extension 42 and are partially enclosed by the action spring guide tubes 41 (shown transparently), as depicted in FIG. 4A.

Figure 5:
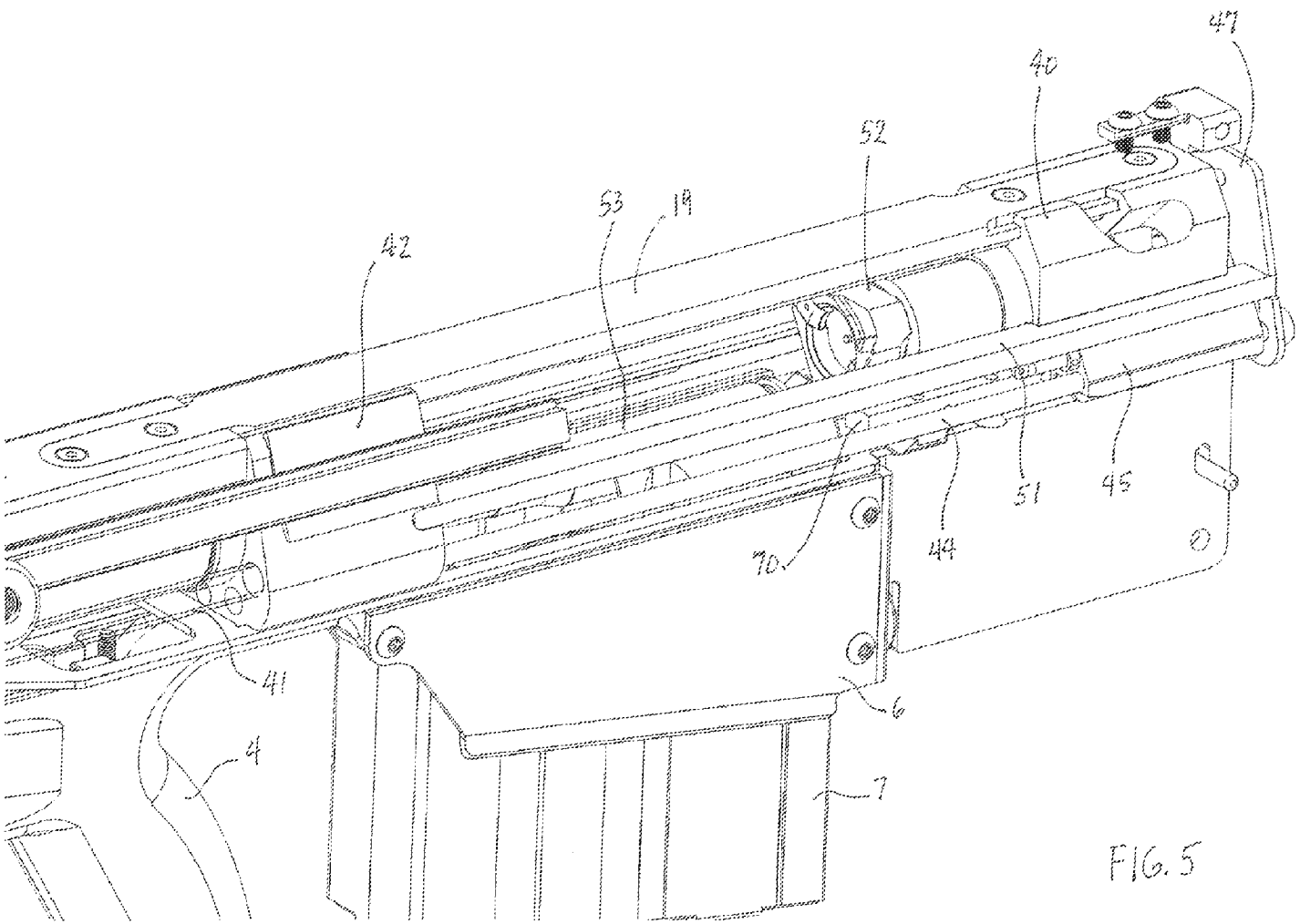
FIG. 5 shows a more detailed view of the slide, bolt carrier group, and hammer.

FIG. 5 provides a closer view of the slide 19, bolt carrier group 40, and the hammer 45. The bolt carrier group 40 is slidably supported by a pair of opposing bolt carrier guide rods 51 fixed between the barrel extension 42 and the action plate 47. In this view, the bolt 52 is in its most rearward position just behind a round 53 in the magazine 7.

Figure 5A:
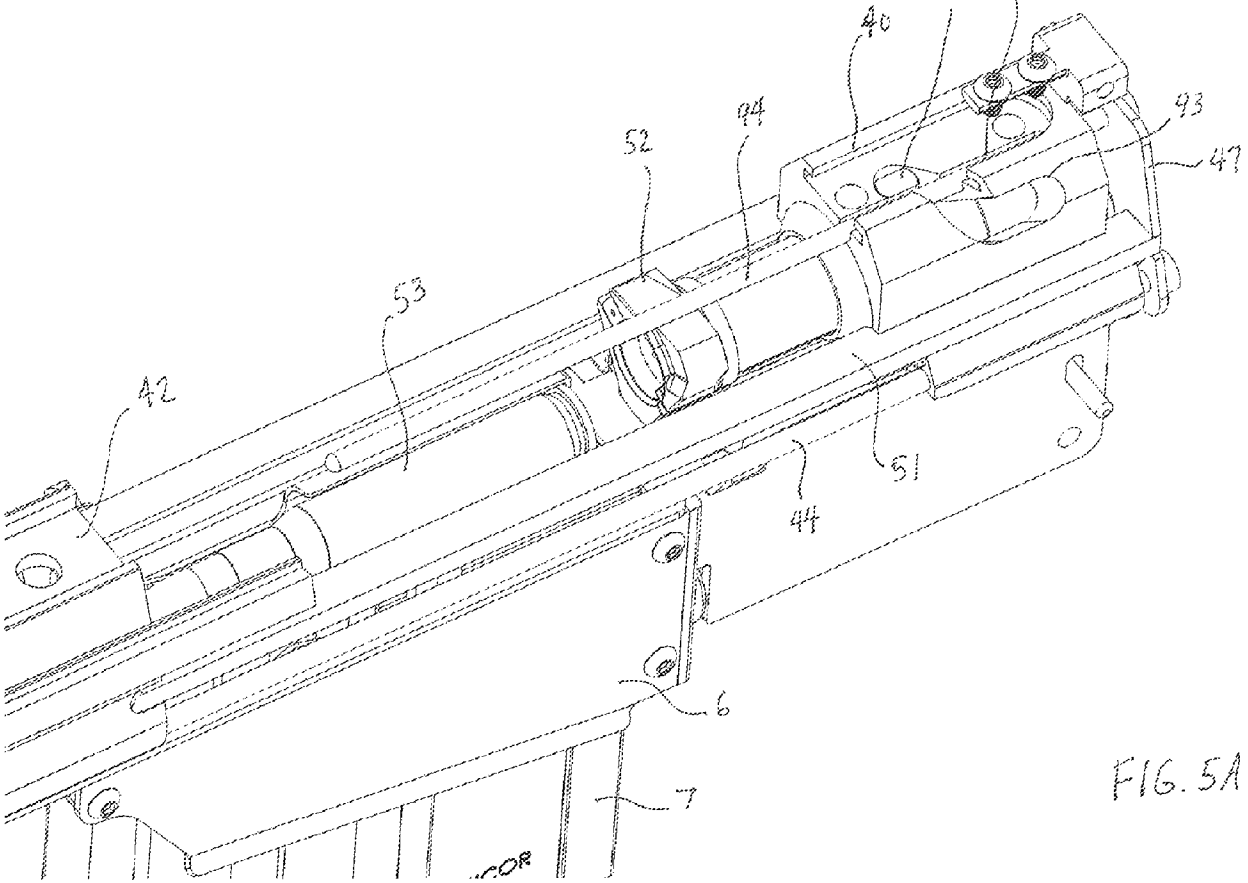
FIG. 5A shows a detailed view of the bolt, the cam pin, and cam pin guide rod.

FIG. 5A is a detailed view of the bolt 52 within the bolt carrier 40, wherein several adjacent parts are removed from the illustration for clarity. The bolt 52 includes a cam pin 92 which resides along a curved slot 93 formed into the bolt carrier 40. To ensure correct orientation of the bolt 52 as it enters the barrel extension 42, a cam pin guide rod 94 is attached to the action plate 47. Importantly, the cam pin guide rod 94 resides within a guide rod slot 95 (rather than a hole) formed into the bolt carrier 40. The cam pin guide rod 94 extends forward form the action plate 47 until a point where the bolt 52 is required to rotate. As the bolt carrier 40 moves forward, the cam pin 92 on the bolt 52 moves past the end of the cam pin guide rod 94, the bolt 52 is free to rotate, and the cam pin 92 travels through the curved slot 93 during the chambering of a round 53. After a round 53 is fired, the bolt 52 travels rearward and away from the barrel extension 42, causing the bolt 52 to rotate back to its original vertical orientation, while the cam pin guide rod 94 keeps the bolt 52 in the proper orientation for the next round 53 to be chambered. The formation of the guide rod slot 95 has distinct advantages over the prior art, because it avoids having to drill a long and high-tolerance hole in the bolt carrier 40.

Figure 6:
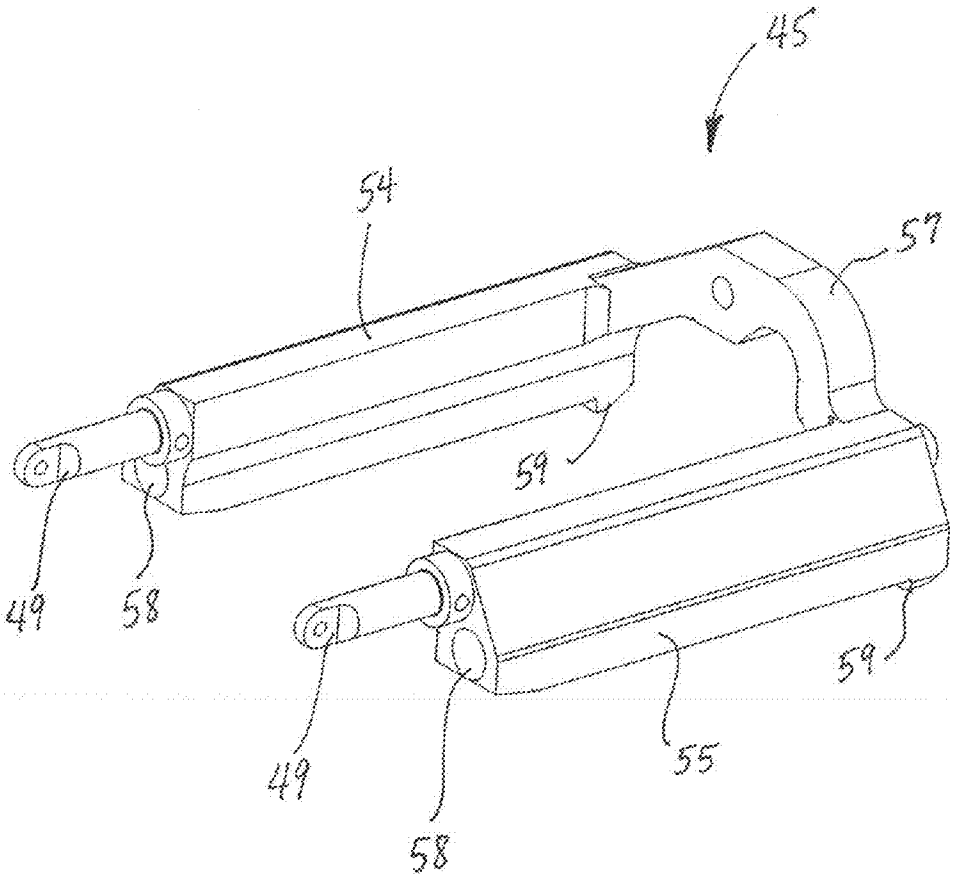
FIG. 6 shows a detailed view of the linear hammer.
Figure 7:
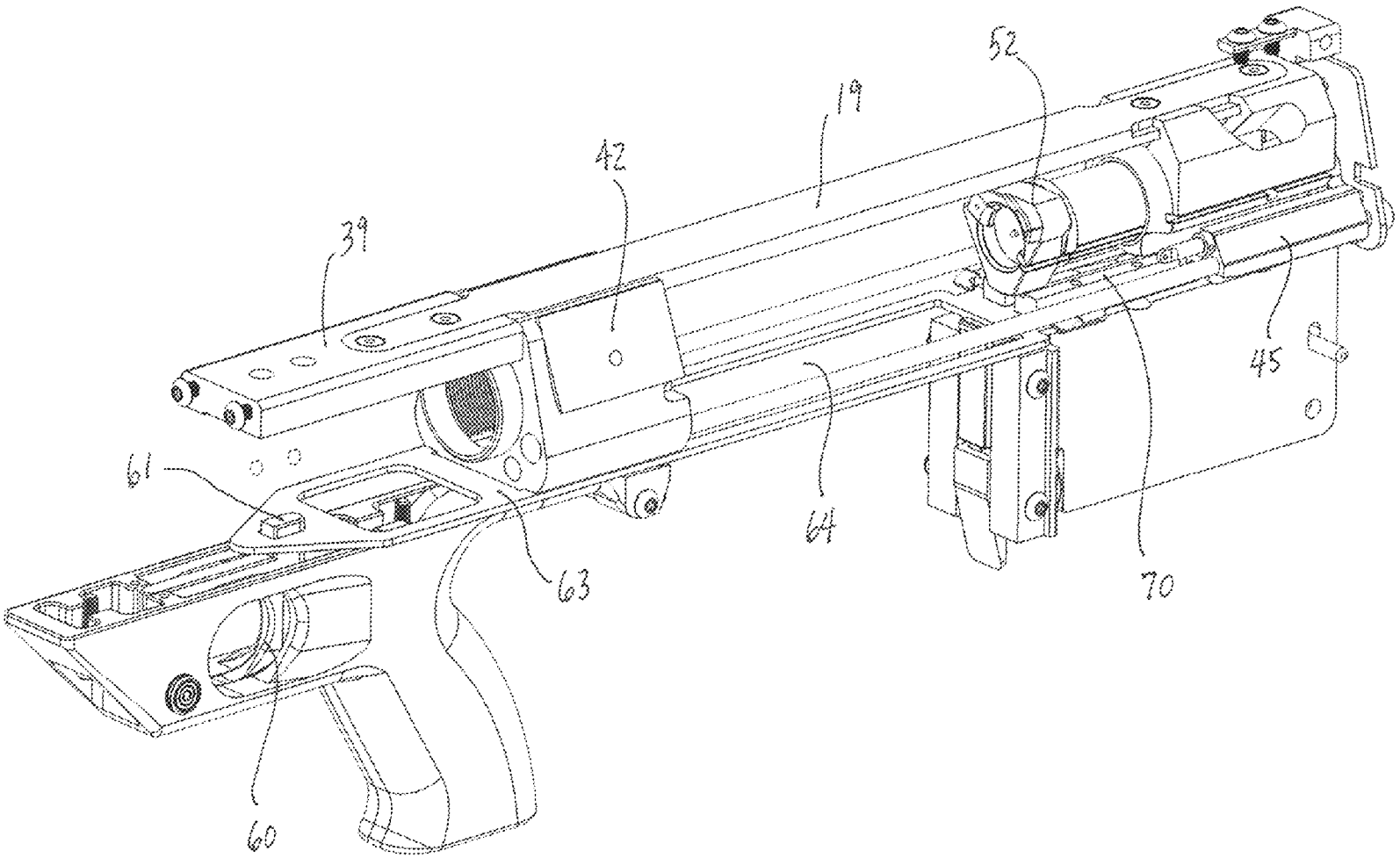
FIG. 7 shows a detailed view of the ignition plate and sear assembly.

FIG. 6 is a more detailed view of the linear hammer 45, which comprises a pair of body portions 54, 55 connected by rear support cross member 57. Body portions 54, 55 each include a tubular channels 58 for interfacing with the hammer guide rods 44. The rear support cross member 57 includes a raised portion which communicates with the firing pin to fire a round. A pair of hammer tabs 59 extend below the hammer 45, which provide a surface for engagement by the sear grips 77 as explained below. FIG. 7 is a more detailed view of the ignition system, with several surrounding parts removed for clarity. The trigger 60 includes a trigger extension 61 which engages a mating aperture in an ignition plate 63. The ignition plate 63 extends from the trigger 60, under the barrel extension 42, and finally to the sear assembly 70. The ignition plate 63 includes a large rectangular opening 64 for accommodating the magazine 7 and its rounds. Upon pulling the trigger 60, the ignition plates 63 engages the sear assembly 70 to release the hammer 45.

Figure 8:
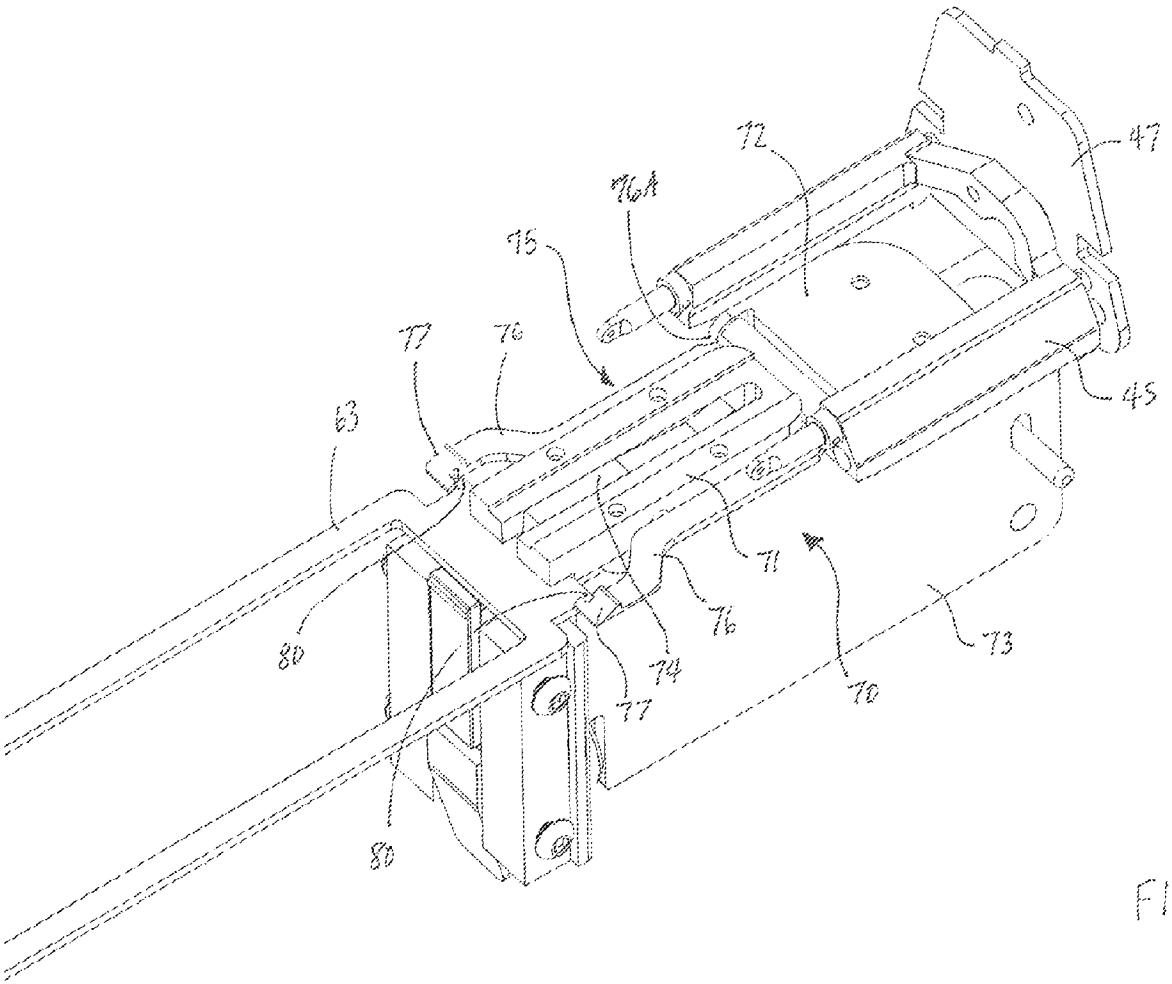
FIG. 8 shows a further detailed view of the sear assembly and hammer.

FIG. 8 is a more detailed view of the ignition plate 63, sear assembly 70, and hammer 45. FIGS. 9A-9D are additional isolated views of the sear assembly 70 and its major parts. The sear assembly 70 comprises a sear platform 71 and a sear holder 72, each of which is separately bolted to a support base 73. The sear platform 71 includes an elongated slot which pivotally retains the disconnector 74 (shown best in FIG. 9D) via horizontal pin 82 and spring 56. Spring 56 causes the disconnector 74 to be biased toward a forward position (toward the front of the rifle). The disconnector 74 is normally biased in an upward position by a spring-loaded pin 83 extending from the support base 73. The sear holder 72 pivotally retains the sear 75 at sear pin 76A, and the sear 75 includes a pair of sear arms 76. The sear arms 76 extend around the sear platform 71 and include sear grips 77. The sear grips 77 have two functions, namely, keeping the hammer 45 in a cocked position, and engaging a pair of tabs 80 on the ignition plate 63 to prevent inadvertent release of the hammer 45.

Figure 9A:
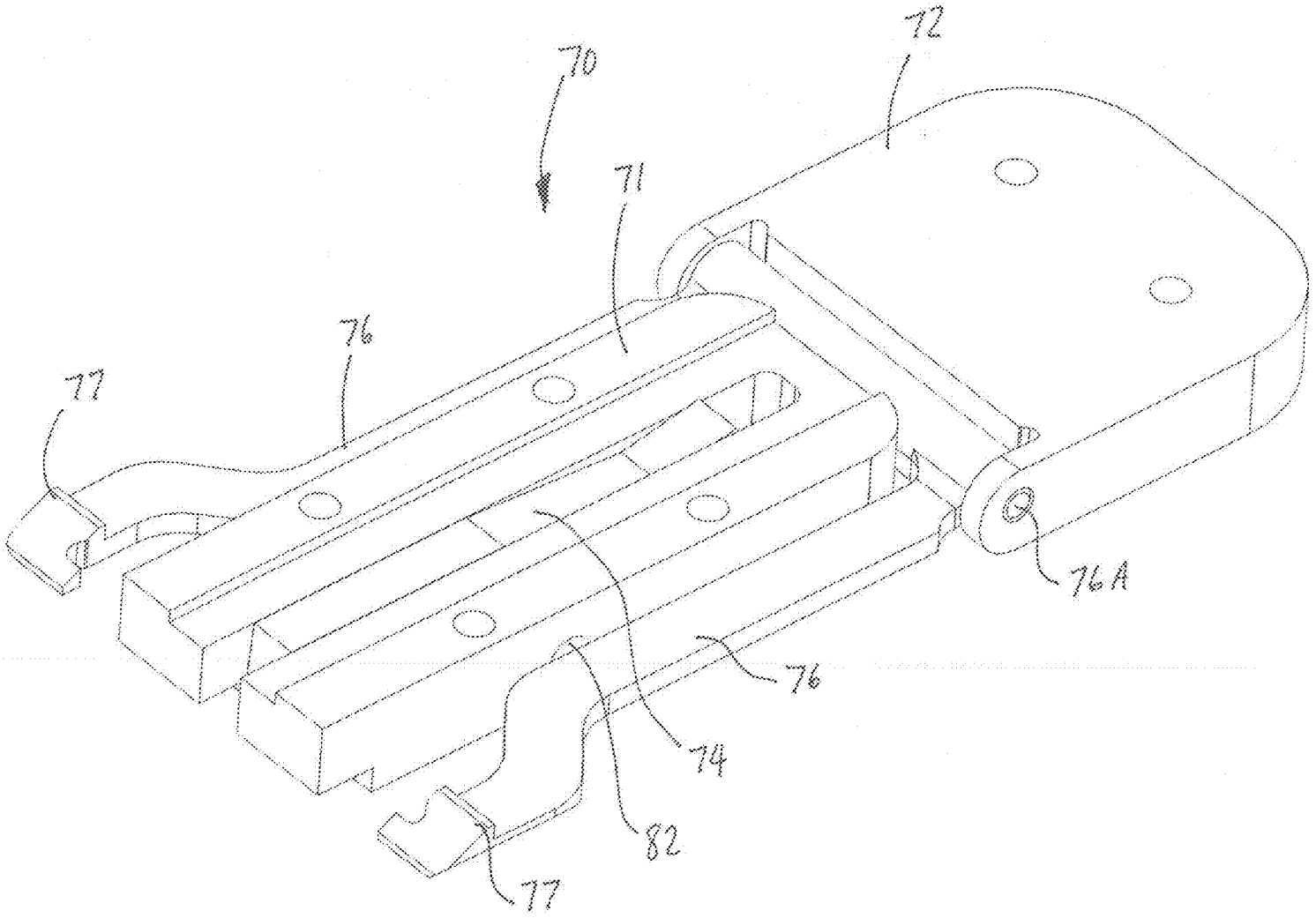
FIGS. 9A-9D show further detailed views of the sear assembly and disconnector.
Figure 9B:
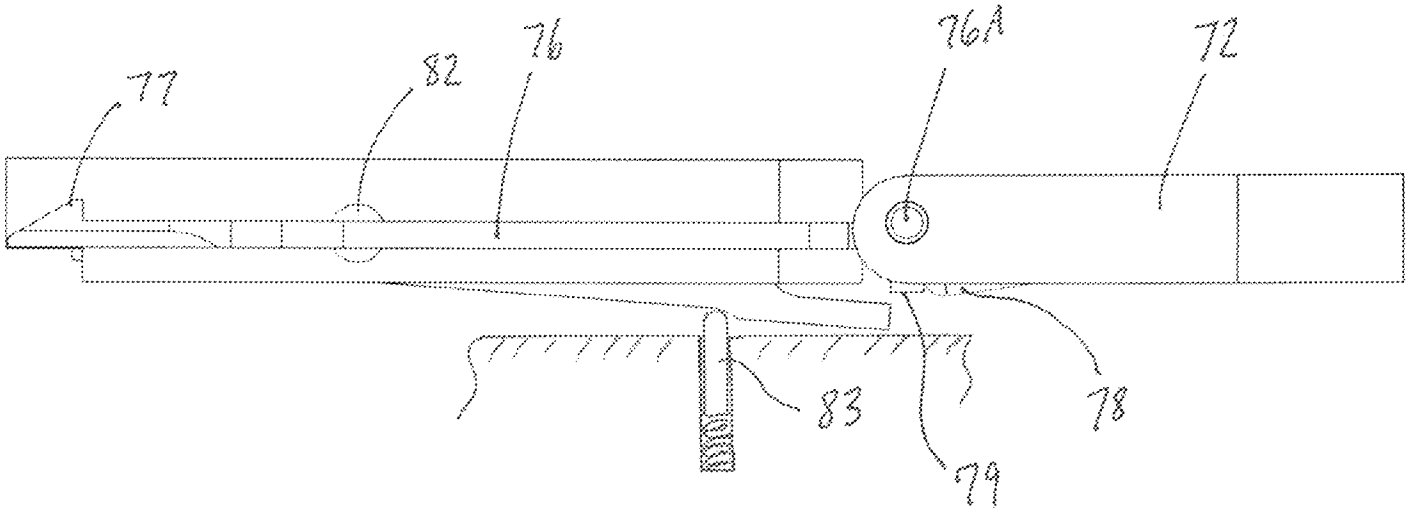
Figure 9C:
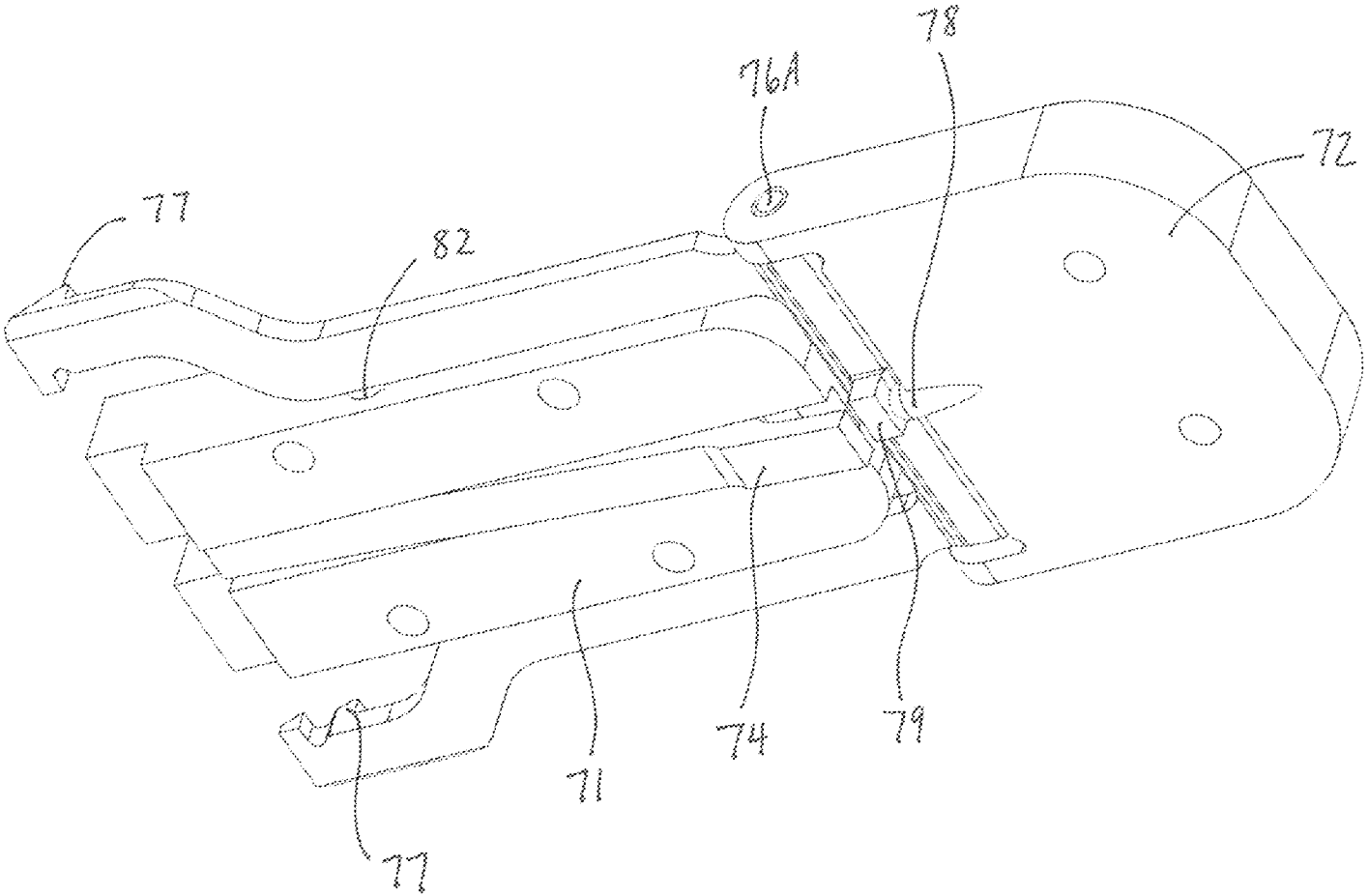
Figure 9D:
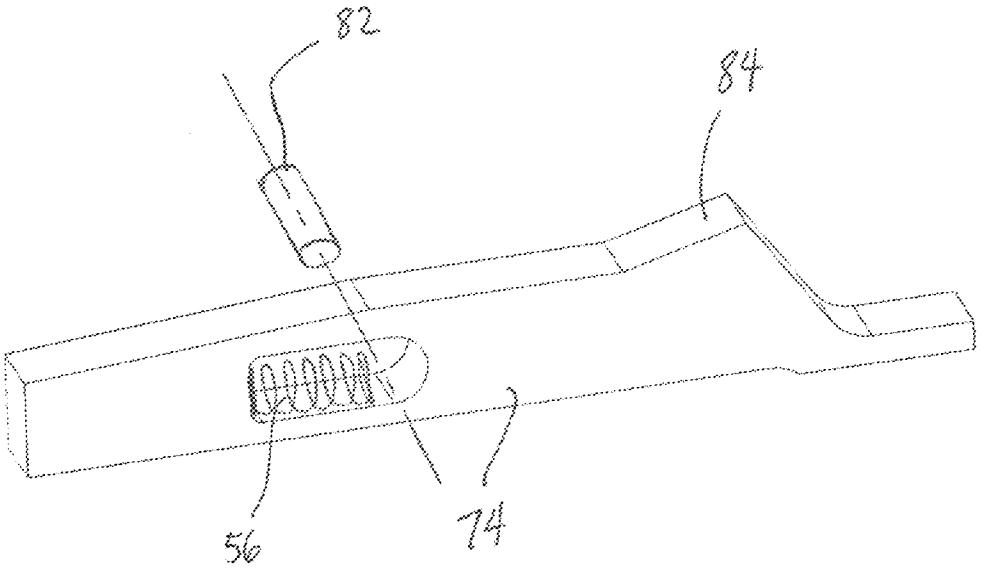
Figure 10:
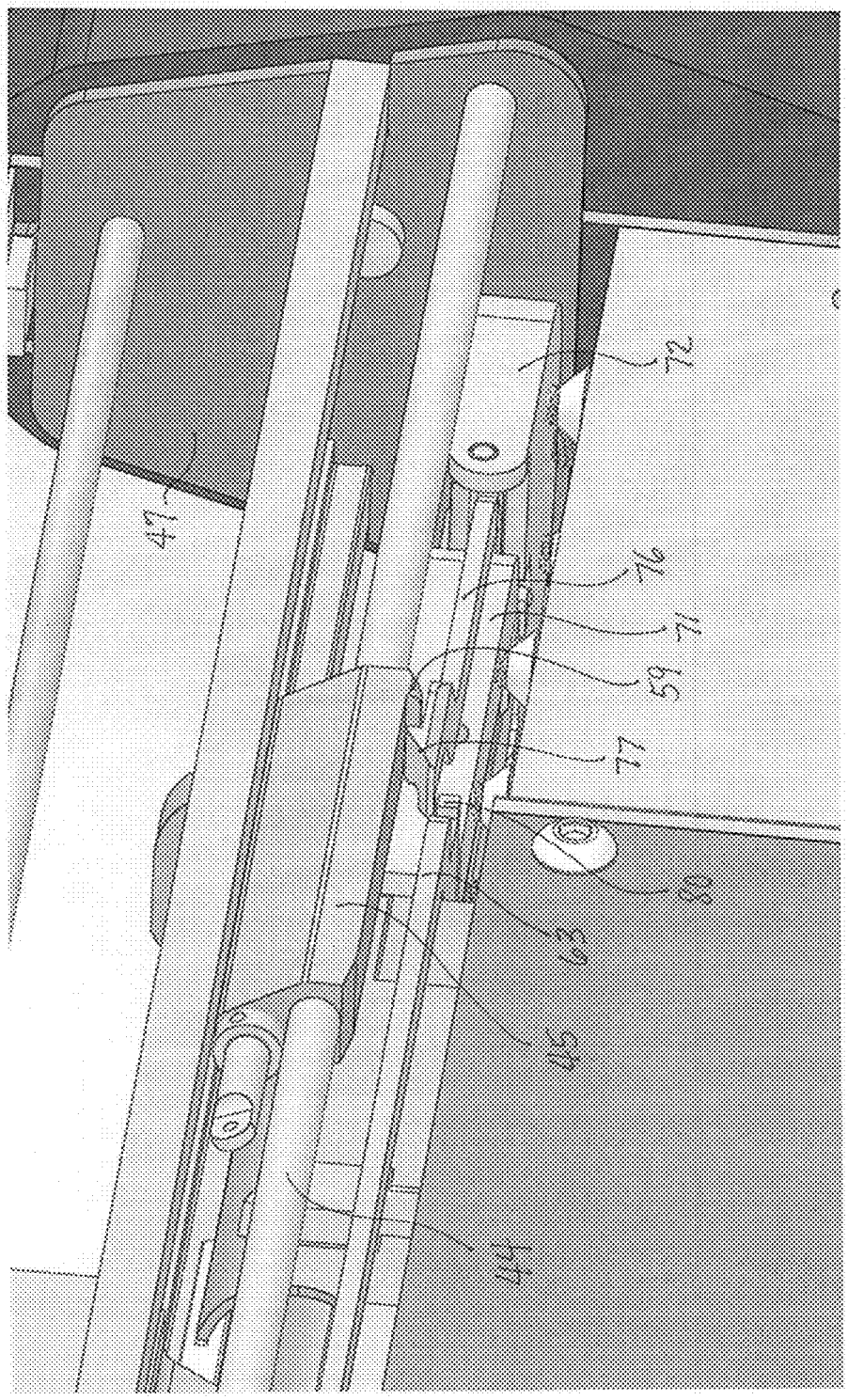
FIG. 10 shows the hammer in a cocked position, being retained by the sear arms.
Figure 11:
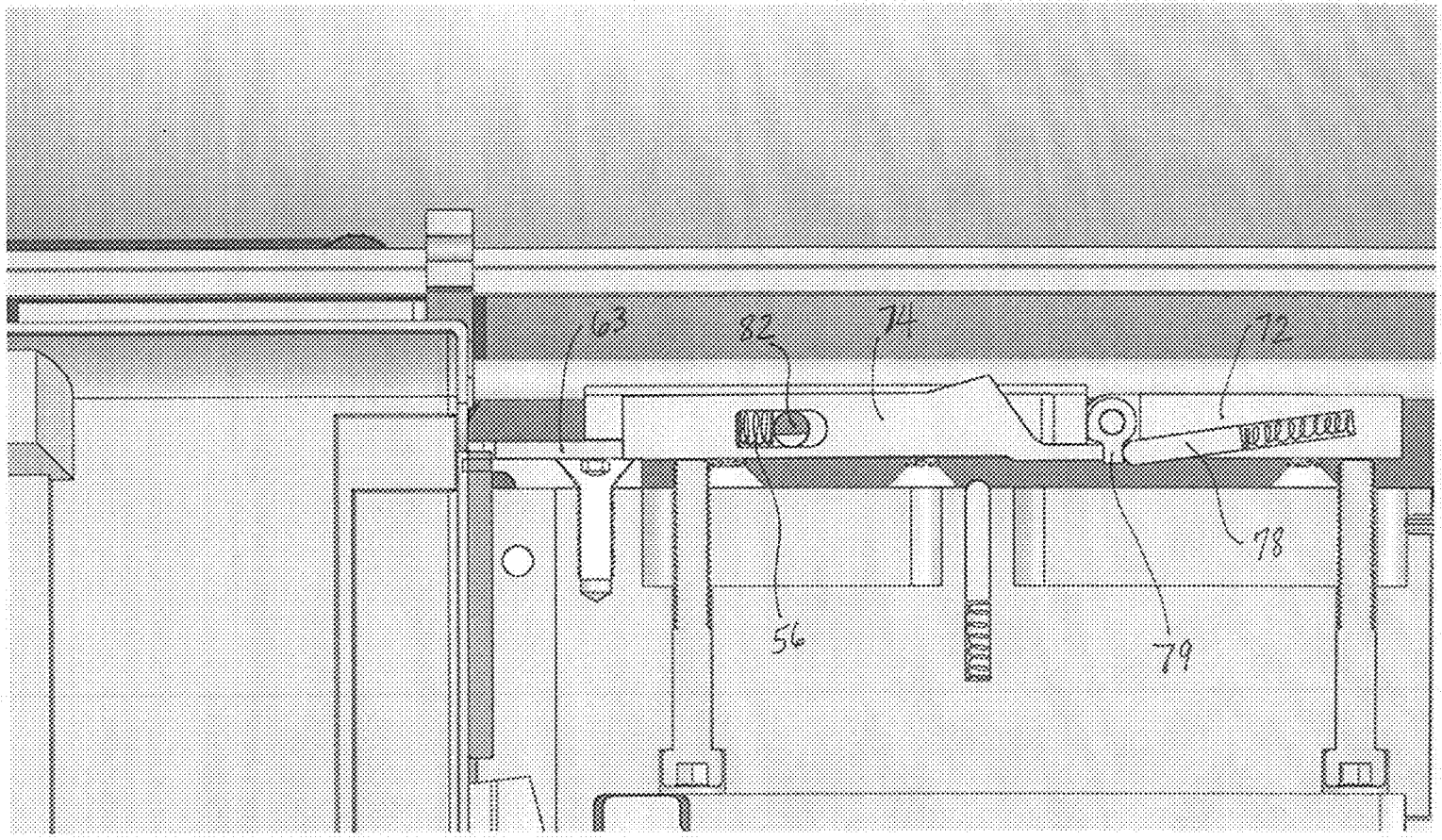
FIG. 11 shows the disconnector in a position for release of the sear.
Figure 12:
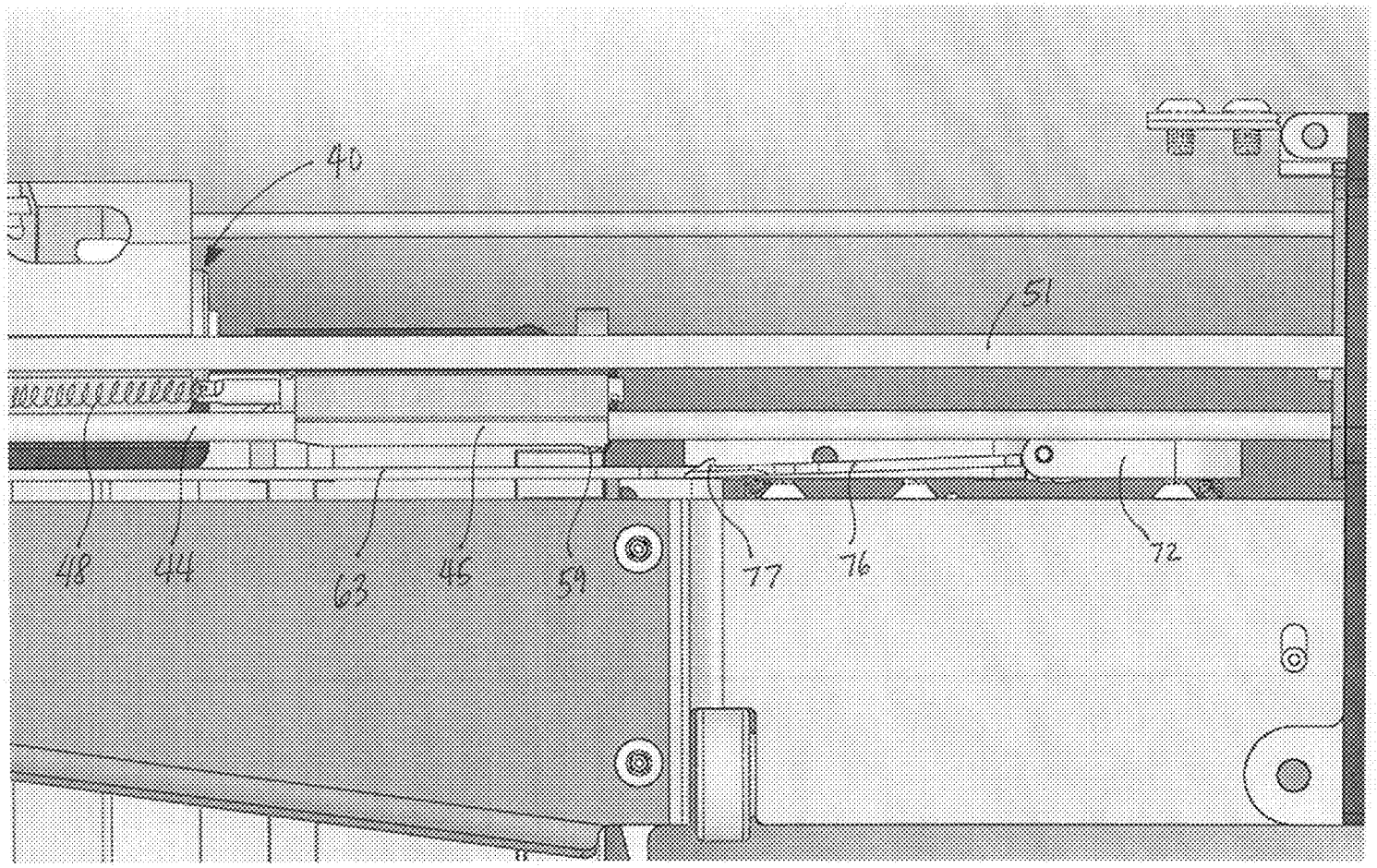
FIG. 12 shows the hammer after release and the position of the sear arms.

For the hammer 45 to be in a cocked position, the sear 75 resides in a horizontal orientation, and it is retained in that position by a spring-loaded pin 78 extending from the sear holder 72, as shown best in FIGS. 9B and 9C. The sear grips 77 are in contact with the hammer tabs 59, preventing the hammer 45 from being released, best shown in FIG. 10 from the left side of the rifle 1. Note that the sear grips 77 are positioned above and in contact with the ignition plate tabs 80, which prevents the sear 75 from lowering until after the trigger 60 is pulled. The spring-loaded pin 78 is in biased contact against a boss 79 extending from the bottom of the sear 75. Because of this arrangement, the sear 75 is only moved from its horizontal position when the disconnector 74, urged by the movement of the ignition plate 63 due to a trigger pull, is caused to push the boss 79 against the spring-loaded pin 78. This relationship is also shown in a partial cross-sectional view of FIG. 11. When this action occurs, the sear 75 and its sear arms 76 pivot downward, causing the sear grips 77 to leave their contact with the hammer tabs 59, thereby releasing the hammer 45 to strike the firing pin. FIG. 12 depicts the sear arms 76 in their downward position, and the hammer 45 having been released.

Figure 13:
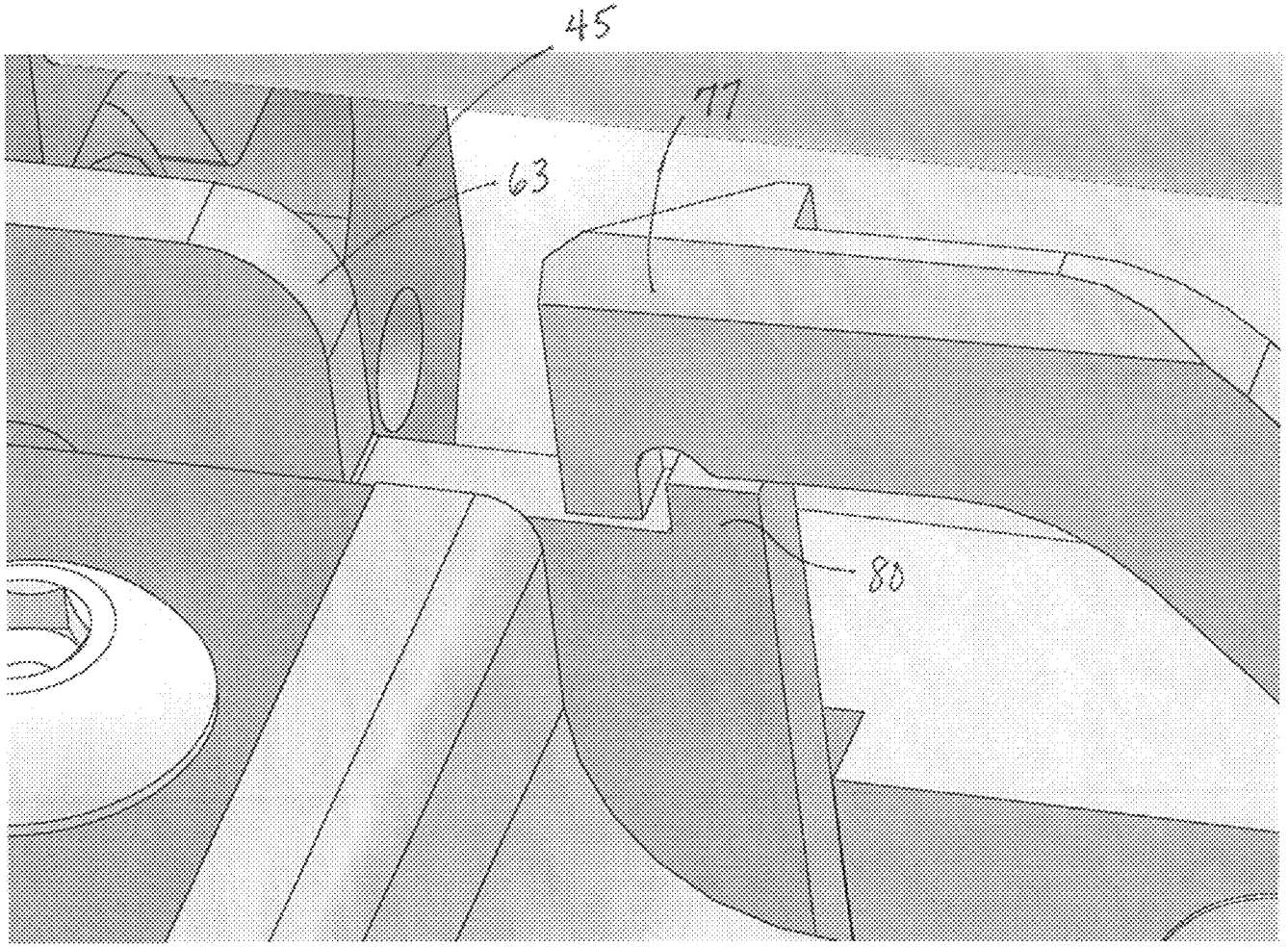
FIG. 13 shows the sear grips engaged with tabs on the ignition plate.

Upon pulling the trigger 60 and release of the hammer 45, the ignition plate tabs 80 move backwards, allowing the sear grips 77 to move downward. FIG. 13 depicts this relationship in a close-up view from the left underside of the sear grip 77 and ignition plate 63. During this event, the round has been fired, and the combination of recoil and gases operating on the gas piston 31 cause the bolt carrier group 40 and the hammer 45 to move rearward as a unit.

Figure 14:
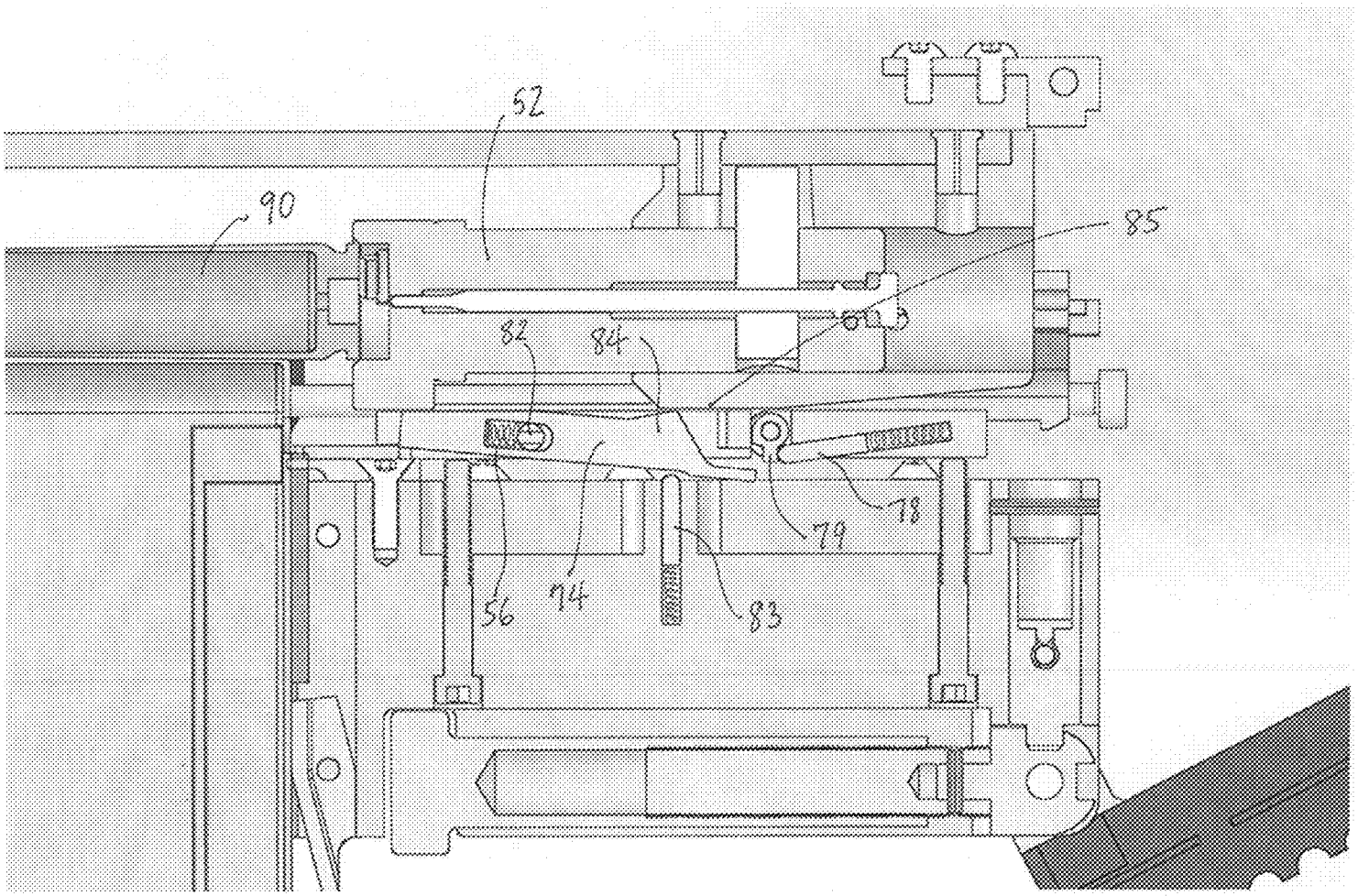
FIG. 14 shows the sear and disconnector being reset by movement of the bolt.

In the travel rearward, the spent case 90 is pulled back and ejected, and the underside 85 of the bolt carrier moves over a ramped portion 84 of the disconnector 74, causing it to temporarily pivot downward and below the boss 79 on the sear 75 against the bias of spring-loaded pin 83. This is depicted in the partial cross-sectional view of FIG. 14. This downward movement of the disconnector 74 allows the sear 75 to rotate back to its horizontal position due to the urging of spring-loaded pin 78. This has two important effects. First, it causes the sear grips 77 to raise back to a position above the tabs 80 on the ignition plate 63, so that when the trigger 60 is returned to its original position, the sear grips 77 are again prevented from dropping by contact with the ignition plate tabs 80. And second, the sear grips 77 are now repositioned to catch the hammer tabs 59 on the hammer 45, leaving it cocked for the next firing of a round. As the hammer 45 remains back in its cocked position, the bolt carrier group 40 is urged forward by the action springs 46. As the bolt carrier group 40 slides over and leaves the disconnector 74, the disconnector 74 is urged back into its forward and upward position by spring 56 and spring-loaded pin 83, respectively, which re-aligns the disconnector 74 with the boss 79, ready for another pull of the trigger 60. As the bolt carrier group 40 continues forward, it strips another round from the magazine 7 and loads it into the chamber, and the rifle 1 is ready to fire again.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only, and the scope of the present invention is to be limited only by the following claims.

The invention claimed is:

1. A rifle in a bullpup configuration, comprising:

a receiver having a trigger assembly and a magazine well;

a barrel having a muzzle end disposed in front of the trigger assembly and a barrel extension attached to the receiver;

a gas assist system, including a gas housing surrounding the barrel and having an annular expansion chamber surrounding the barrel, and an annular gas piston slidably disposed within the annular expansion chamber;

a thrust block in contact with the gas piston, wherein the thrust block is slidably disposed along an outer surface of one or more action guide members;

a rigid slide member having a first end and a second end, wherein the first end is connected to the thrust block, and wherein the second end extends behind the trigger assembly;

a bolt carrier having a bolt and firing pin, attached to the second end of the slide member and slidably disposed along one or more bolt guide members;

a linear hammer slidably disposed along one or more hammer guide members, adapted to travel in a direction parallel to the bolt and to contact the firing pin; and a sear assembly within the receiver having a sear member to retain the hammer, and a disconnector in communication with the sear member to release the hammer upon actuation of the trigger assembly.

2. The rifle according to claim 1, wherein the trigger assembly includes:

a trigger; and an ignition plate connected to the trigger, wherein the ignition plates extends across the magazine well to the sear assembly.

3. The rifle according to claim 2, wherein the ignition plate includes an opening for passage of a magazine.

4. The rifle according to claim 1, wherein the barrel includes a muzzle brake.

5. The rifle according to claim 1, wherein the linear hammer includes at least two body portions and a hammer member, wherein the body portions each include a tubular channel mated to the respective hammer guide members.

6. The rifle according to claim 5, wherein the hammer includes at least two hammer spring rods extending from the hammer, and further including at least two hammer springs connected to the hammer spring rods.

7. The rifle according to claim 6, wherein the action guide members are tubular, and wherein the hammer springs are at least partially retained within the action guide members.

8. The rifle according to claim 1, wherein the action guide members include one or more action springs between the thrust block and the barrel extension.

9. The rifle according to claim 1, wherein the hammer includes one or more hammer tabs adapted to engage the sear member.

10. The rifle according to claim 2, wherein the sear member comprises a pair of sear arms rotatably connected to a sear holder, and wherein each sear arm includes a sear grip adapted to retain the hammer.

11. The rifle according to claim 10, wherein the ignition plate communicates with the disconnector, wherein the disconnector communicates with a boss on the sear member, and wherein the disconnector causes the sear arms to disengage the hammer.

12. The rifle according to claim 10, wherein the ignition plate includes ignition tabs, and where the sear arms are prevented from rotation when in contact with the ignition tabs.

13. The rifle according to claim 10, wherein the disconnector is resiliently biased in a forward and upward position relative to the receiver.

14. The rifle according to claim 10, wherein the sear member is resiliently biased in a position to retain the hammer.

15. The rifle according to claim 10, wherein the disconnector is responsive to movement of the bolt carrier, and wherein the disconnector is reset to a firing position after the bolt carrier returns to the barrel extension.

16. The rifle according to claim 1, wherein the bolt includes a cam pin, wherein the receiver includes a cam pin guide rod, wherein the cam pin guide rod is slidably disposed within a guide slot formed into the bolt carrier, and wherein the cam pin is retained in a predetermined orientation until the cam pin clears the cam pin guide rod.

17. A rifle, comprising:

a receiver having a trigger assembly and a magazine well;

a barrel attached to the receiver and having a muzzle end disposed in front of the trigger assembly;

a gas assist system, including a gas housing surrounding the barrel and having an annular expansion chamber surrounding the barrel, and an annular gas piston slidably disposed within the annular expansion chamber;

a thrust block in contact with the gas piston, wherein the thrust block is slidably disposed along an outer surface of one or more action guide members;

a rigid slide member having a first end and a second end, wherein the first end is connected to the thrust block, and wherein the second end extends behind the trigger assembly; and a bolt carrier having a bolt and firing pin, attached to the second end of the slide member and slidably disposed along one or more bolt guide members.

18. The rifle according to claim 17, wherein the trigger assembly includes:

a trigger; and an ignition plate connected to the trigger, wherein the ignition plates extends across the magazine well to the sear assembly.

19. The rifle according to claim 18, wherein the ignition plate includes an opening for passage of a magazine.

20. The rifle according to claim 17, wherein the action guide members include one or more action springs between the thrust block and the receiver.

21. The rifle according to claim 17, wherein the bolt includes a cam pin, wherein the receiver includes a cam pin guide rod, wherein the cam pin guide rod is slidably disposed within a guide slot formed into the bolt carrier, and wherein the cam pin is retained in a predetermined orientation until the cam pin clears the cam pin guide rod.

22. A rifle, comprising:

a receiver having a trigger assembly and a magazine well;

a barrel attached to the receiver and having a muzzle end disposed in front of the trigger assembly;

a thrust block slidably disposed along an outer surface of one or more action guide members and configured to be contacted by an annular gas piston of a gas assist system;

a rigid slide member having a first end and a second end, wherein the first end is connected to the thrust block, and wherein the second end extends behind the trigger assembly;

a bolt carrier having a bolt and firing pin, attached to the second end of the slide member and slidably disposed along one or more bolt guide members;

a linear hammer slidably disposed along one or more hammer guide members, adapted to travel in a direction parallel to the bolt and to contact the firing pin; and a sear assembly within the receiver having a sear member to retain the hammer, and a disconnector in communication with the sear member to release the hammer upon actuation of the trigger assembly.

23. The rifle according to claim 22, wherein the trigger assembly includes:

a trigger; and an ignition plate connected to the trigger, wherein the ignition plates extends across the magazine well to the sear assembly.

24. The rifle according to claim 23, wherein the ignition plate includes an opening for passage of a magazine.

25. The rifle according to claim 22, wherein the linear hammer includes at least two body portions and a hammer member, wherein the body portions each include a tubular channel mated to the respective hammer guide members.

26. The rifle according to claim 25, wherein the hammer includes at least two hammer spring rods extending from the hammer, and further including at least two hammer springs connected to the hammer spring rods.

27. The rifle according to claim 26, wherein the action guide members are tubular, and wherein the hammer springs are at least partially retained within the action guide members.

28. The rifle according to claim 22, wherein the action guide members include one or more action springs between the thrust block and the receiver.

29. The rifle according to claim 22, wherein the hammer includes one or more hammer tabs adapted to engage the sear member.

30. The rifle according to claim 22, wherein the sear member comprises a pair of sear arms rotatably connected to a sear holder, and wherein each sear arm includes a sear grip adapted to retain the hammer.

31. The rifle according to claim 30, wherein the ignition plate communicates with the disconnector, wherein the disconnector communicates with a boss on the sear member, and wherein the disconnector causes the sear arms to disengage the hammer.

32. The rifle according to claim 30, wherein the ignition plate includes ignition tabs, and where the sear arms are prevented from rotation when in contact with the ignition tabs.

33. The rifle according to claim 30, wherein the disconnector is resiliently biased in a forward and upward position relative to the receiver.

34. The rifle according to claim 30, wherein the sear member is resiliently biased in a position to retain the hammer.

35. The rifle according to claim 30, wherein the disconnector is responsive to movement of the bolt carrier, and wherein the disconnector is reset to a firing position after the bolt carrier returns to the barrel extension.

36. The rifle according to claim 22, wherein the bolt includes a cam pin, wherein the receiver includes a cam pin guide rod, wherein the cam pin guide rod is slidably disposed within a guide slot formed into the bolt carrier, and wherein the cam pin is retained in a predetermined orientation until the cam pin clears the cam pin guide rod.

* * * * *